United States Patent [19]

Wu

[11] Patent Number: 4,770,647

[45] Date of Patent: Sep. 13, 1988

[54] ELECTRICAL PLUG AND SOCKET HAVING REPLACEABLE OVERCURRENT PROTECTION DEVICE WITH SAFETY LATCH MEANS

[76] Inventor: Jeng-Shyong Wu, 133 Tungshing Road, Toufun, Maulii, Taiwan

[21] Appl. No.: 894,349

[22] Filed: Aug. 7, 1986

[51] Int. Cl.[4] ..... H01R 13/68

[52] U.S. Cl. ..... 439/622; 337/197

[58] Field of Search ..... 337/197, 198, 201, 264; 339/147 P, 147 R, 63 R, 63 M, 196 R, 196 A, 166 R, 166 M; 439/621, 622, 597-601, 651, 692-697

[56] References Cited

U.S. PATENT DOCUMENTS 3,031,637 4/1962 Descarries ..... 339/196 R
4,420,214 12/1983 Wu ..... 339/147 P
4,480,891 11/1984 Wu ..... 339/147 P

FOREIGN PATENT DOCUMENTS 634486 8/1936 Fed. Rep. of Germany .... 339/63 R

*Primary Examiner*—Gil Weidenfeld
*Assistant Examiner*—Gary F. Paumen
*Attorney, Agent, or Firm*—McGlew and Tuttle

[57] ABSTRACT

The invention relates to an electrical plug having insulating inner housing with a channel therein. A pair of conductors extending into the channel are provided having terminals fixed to ends thereof and disposed in the channel. A seat of insulated material is positioned in the channel between the terminals for fixing the terminals in the channel. A pair of contacts extend into the insulating housing having at least a portion communicating with the channel. A securing body of insulating material is disposed in the channel between the contacts for holding the prongs to the insulating housing, the securing body being removable from the inner housing. The housing being removably inserted within the through opening of an outer casing with spurs engaging the recesses.

5 Claims, 5 Drawing Sheets

ELECTRICAL PLUG AND SOCKET HAVING REPLACEABLE OVERCURRENT PROTECTION DEVICE WITH SAFETY LATCH MEANS

BACKGROUND OF THE INVENTION

The present invention relates generally to electrical plugs and sockets and more particularly to an electrical plug or socket having a replaceable overcurrent protection device provided with safety latch means.

SUMMARY AND OBJECT OF THE INVENTION

This application is related to a previous application Ser. No. 06/693,015 filed on Jan. 18, 1985 with the same title, now abandoned. The present application provides additional features including an inverted spur and recess between the outer casing and inner seat. The casing and inner seat parts are made separable so that the inner seat, with a contact pair and conductor pair mounted thereupon, is entirely removable out of the casing for maintenance and replacement of parts including overcurrent protection device wherever applicable.

It is an object of this continuation-in-part application to provide an inverted-spur and recess connection between inner seat and outer casing junction for an electrical plug or socket.

The various features of novelty which characterize the invention are pointed out with particularity in the claims annexed to and forming a part of this disclosure. For a better understanding of the invention, its operating advantages and specific object obtained by its use, reference is made to the accompanying drawings and descriptive matter in which the preferred embodiments of the invention are illustrated.

DESCRIPTION OF THE PREFERRED EMBODIMENTS

The present invention will be described with reference to FIGS. 1A–1F and FIGS. 7A–7C. The numbered parts referred to in FIGS. 1A–1F and FIGS. 7A–7C are each suffixed in those views which are designated with the letter "B" with a letter "P" so as to distinguish them from similar parts designated with the same numerals which are shown in the other figures.

An electrical socket/plug in accordance with the invention comprises: an insulating housing with a central passage 32P which is communicable with bath ends of the housing; a filling means 421P having a stepped-in/stepped-out portion 422P and 423P; in which and a fixing means 401P on which conductors 42AP and 42BP and terminal 41AP and 41BP are mounted.

The fixing means 401P, with jointed conductors 42AP and 42BP and terminals 41AP and 41BP, is adapted to be positioned in said central passage 32P of the housing. The filling means 421P is used to fill up the depression of the passage 32P. The steped-in/stepped-out portions 422P and 423P of the filling means 421P are respectively adapted to engge the stepped-in/stepped-out portions 424P and 425P of the housing 31P. The fixation of the conductors 42AP and 42BP within the housing 31P is thus attained.

The housing 31P has a channel therein, and a pair of conductors 42AP and 42BP extend into the channel having terminals 41AP and 41BP fixed to ends thereof and also disposed in the channel. A seat of insulated material 401P, positioned in the channel between the terminal 41AP and 41BP, fixes the terminals in the channel.

A pair of contacts, 21AP and 21BP, extend into the insulating housing having, at least, a portion in communication with the channel.

A securing body 210P, made of insulating material, is disposed in the channel between the contacts 21AP and 21BP for holding the contacts to the insulating housing. The "A" like shaped securing body, 210P (FIG. 1D), is positioned in the housing through the housing passage 32P. Two flanges 214AP and 214BP are formed on the two lower sides of the securing body 210P. An "1" (lower case script L) like spring means 219P (FIG. 1F) is retained within the "A" like excavation of the securing body 210P. After the removable securing body 210P has been inserted into the housing 31P, via the biasing of said spring means 219P, flanges 214AP and 214BP are forced to engage into the recesses 26AP and 26BP of the housing 31P.

Fuse plates 12AP and 12BP (FIGS. 1B and 1C) are disposed in the channel and are electrically connected between one contact, 21AP or 21BP, and one terminal, 41AP or 41BP. The securing body 210P is engaged against at least one end of the fuse 12AP or 12BP and between the other fuse 12AP or 12BP for fixing the fuses in the housing 31P.

Figure 1A:
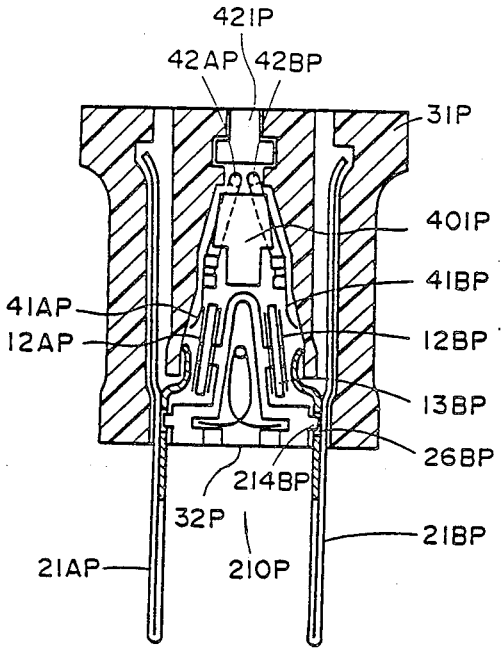
FIG. 1A is a longitudinal sectional view of a preferred embodiment of the plug/socket according to the invention.
Figures 1B, 1C:
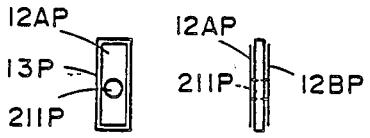
FIG. 1B is a side elevation of a fuse mounting plate showing one fuse plate being attached to each side of said mounting plate.
FIG. 1C is a front view of the plate in the FIG. 18.
Figures 1D, 1E:
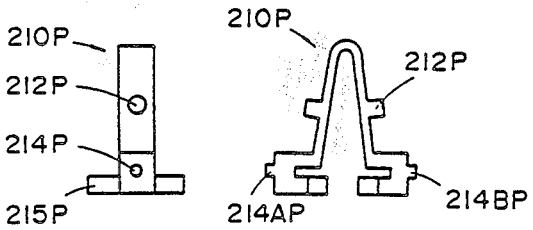
FIG. 1D is a front elevation of the securing body.
FIG. 1E is a side elevation of the same.
Figure 1F:
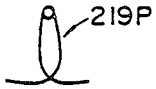
FIG. 1F is a front elevation of a biasing spring.

The overcurrent protection device 211P of FIG. 1B is formed by a double face protection body 12AP, 12BP with a seat plate 13P having a taper mounting hole 211P to be mounted on a taper pin 212P disposed on the "A" formation.

The inconvenience of the conventional plug and socket plus its many drawbacks have caused problems in the past. These drawbacks include unsafe conditions caused by the exposure of the conductive parts, unreliable connections which can be pulled out upon being subjected to force, and difficulty in replacement of overcurrent protecting means.

The main purpose of the present improvement is to provide a rigid, safe, and easy to assemble replacement plug/socket which has all of its parts mounted on an inner seat. Safety is ensured because the inner seat, being entirely buried in an outer casing, is not liable to fall apart when it is pulled.

Everything is hidden within the csing and the inner seat. The parts are easily removable for maintenance and replacement. Because of this, the whole assembly is seldom discarded and is therefore more economical to use.

Since the connection where the conductor meets the terminal is never led outside of the csing, when the plug is subjected to outside force no loosening or falling apart occurs. Therefore, safety is greatly improved by the present invention.

Where a free protection device is used, as the present invention, the advantage of easy replacement of the fuses exists.

Figure 2A:
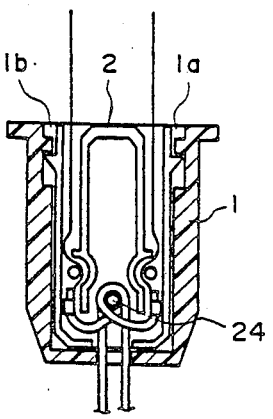
FIG. 2A is a longitudinal section of an embodiment of a plug according to the present invention.
Figure 2B:
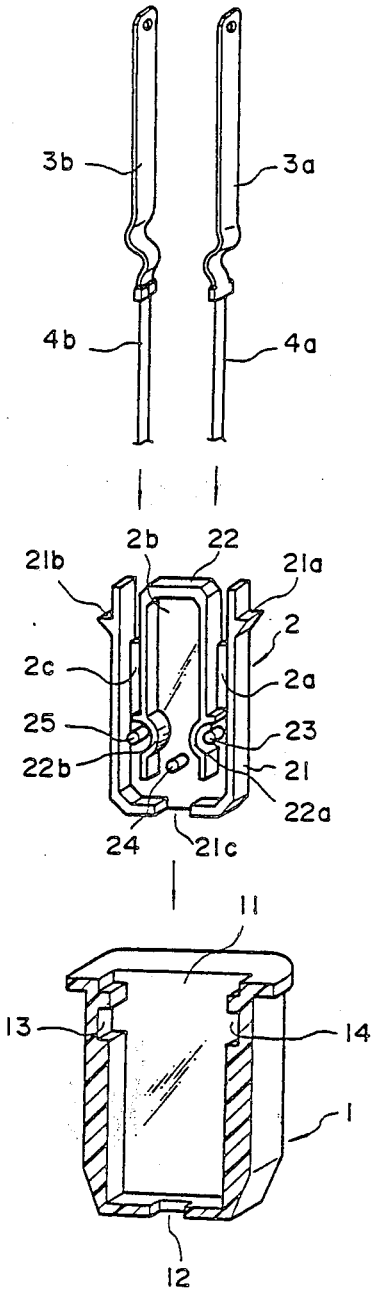
FIG. 2B is an exploded view of the plug in FIG. 2A.

Referring to FIGS. 2A and 2B, the electrical plug/-socket related in this invention comprises generally an outer casing 1, and an inner seat 2, whereupon the contact members and conductor wires are disposed. The casing 1 has an inlet 11 for inserting the inner seat there through, and an outlet 12 for leading out the conductor wires. Inlet 11 and outlet 12 may occupy opposite ends of the casing 1. Inside each of the opposite side walls of the casing 1, are recesses 13 and 14. The inner seat 2 is in the form of a frame and is insertable into the casing 1. The outer frame wall 21 of seat 2 has outer side surfaces which carry inverted spurs 21*a* and 21*b*, disposed to match with the corresponding recesses 13 and 14. At the bottom of the outer frame 21, a conductor hole 21*c* is provided. A partition 22 is disposed in the outer frame 21 and forms with the frame three longitudinal spaces 2*a*, 2*b*, and 2*c*. At the lower part of the partition 22, are respectively formed curved plates 22*a*, 22*b* bent inwardly toward each other, and posts 23, 24, 25 deployed between the curved plates 22*a*, 22*b* and the partition 22.

A pair of somewhat snake shaped connecting contacts 3*a*, 3*b* are placed into the spaces 2*a*, 2*c* within outer frame 21, to match with the spaces formed by the partition 22, the side plate of outer frame 21 and between curved plate 22*a*, 22*b* and the respective post 23, 25. The contacts 3*a*, 3*b* are placed (see FIGS. 2A and 2B) into the inner seat 2 and a respective conductor 4*a*, 4*b* is first wound onto the post 24 and then passed out through conductor lead hole 21*c* at the bottom of the inner frame 21. After the contacts 3*a*, 3*b* are placed inside the inner seat 2, the whole seat may be inserted completely into the casing 1 through the inlet 11. Since the spurs 21*a*, 21*b* are formed invertedly, and inclinations are provided outside the bottom of the inner seat, the insertion can be very quickly affected into the casing 1. The inverted spurs 21*a*, 21*b* in turn are clipped into the recesses 13 and 14. It is to be noted here that clearances 1*a*, 1*b* exist respectively between the outside top of frame 21 of the inner seat 2 and the outer casing 1 after the inner seat 2 is inserted into the outer casing 1, so that a pair of pinch tips may be placed into said clearance and squeezed to force the frame 21 of the inner seat 2 to be released from within the casing 1.

From the above mentioned, it can be clearly seen that the main features of the present invention lie mainly in:

(1) The engagement of the outer casing and the inner seat is made possible by an inverted spur and recess structure which holds tight yet is easily releasable;

(2) The contact member is bent to a multi-curve shaped to cope with the curved space formed within inner seat by way of pre-arranged partitions and posts; and (3) A further post is provided on the inner seat to facilitate winding of the conductor wire before connections so as to provide buffering thereby the conductor wire would not be loosened through pulling.

Figure 3C:
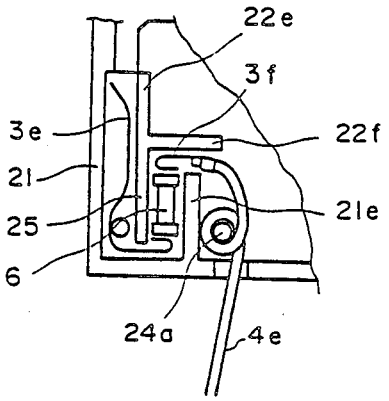
FIG. 3C shows an embodiment of retaining wall structure for the overcurrent protection device.
Figure 3A:
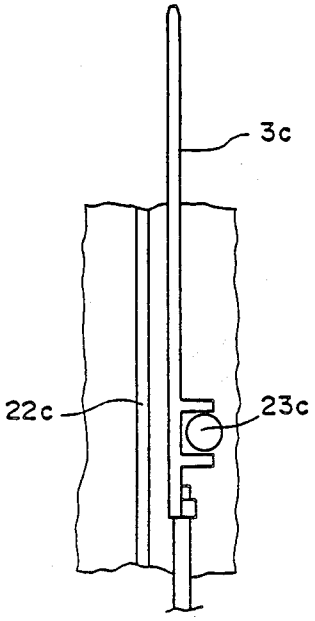
FIGS. 3A and 3B show respectively the sure-grip construction of the contacts.
Figure 3B:
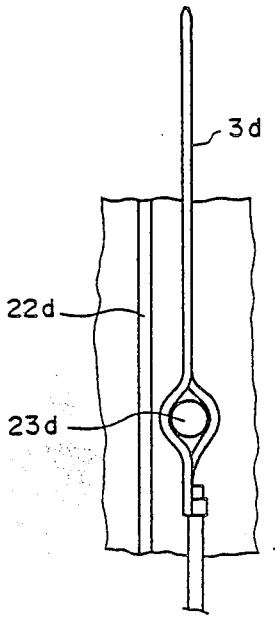

FIG. 3A gives another example showing the sure grip of the prong members. By way of a forked formation on the surface of a prong member 3*c* to clamp tight a post 23*c*, it would not be necessary for the partition 22*c* to be formed onto a curved plate. A likewise manner is shown in FIG. 3B, wherein the prong member 3*d* is formed with a loophole by splitting the width of the prong member to enclose the post splitting the width of the prong member to enclose the post 23*d*. The partition 22 is again without curvature.

In FIG. 3C, a lateral plate 22*f* is protruded from the partition 22*e* of the inner seat 2, a longitudinal plate 21*e* is protruded from the partition bottom frame 21, thereby a fuse retaining chamber 25 is formed. The end of a contact 3*e* is bent into chamber 25 to resiliently contact one end of the fuse 6 without extra conducting wire, conductor 4*e* with terminal 3*f* is also bent to contact another end of the fuse 6. With the simple accommodation of a retaining chamber like this, the plug can take a fuse immediately.

Figure 4:
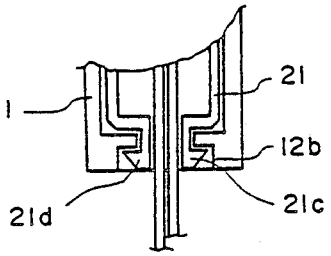
FIG. 4 is an embodiment showing the inverted spur and recess connection between the inner seat and the outer casing.

In FIG. 4, the inverted spurs 21*c*, 21*b* are formed outside the bottom of outer frame 21 of the inner seat 2, the recesses 21*c*, 21*d* are in turn formed at corresponding position 12*b* where the conductor are led out. Thus, the spurs 21*c*, 21*d* can easily be squeezed from the outside to cause the release of the inner seat 2 from outer casing 1.

Figure 5:
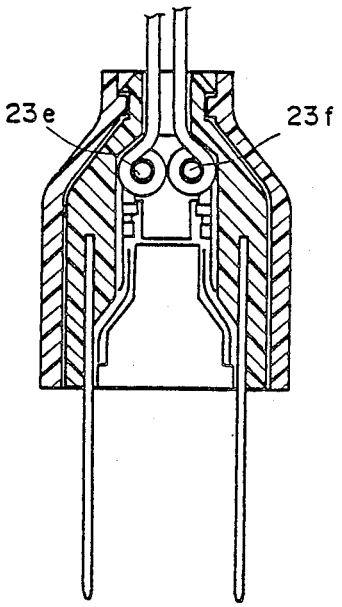
FIG. 5 is a sectional view of an electrical plug employing the spur recess connection of the present invention.

In a further embodiment shown in FIG. 5, each conductor is wound upon respective post 23*e*, 23*f* before being connected to its respective terminal. The spur-recess construction is the same as shown in FIG. 4.

Figure 6:
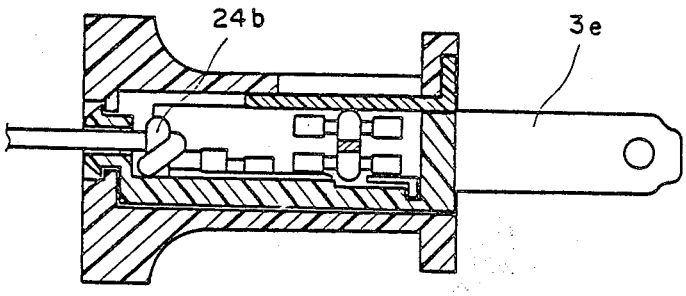
FIG. 6 is a sectional view of another form of plug employing the connection according to the present invention.

In FIG. 6, the conductor is first wound about a post 24*b* and the replacement of the fuse can be effected through a sliding side door. This drawing aims at showing the versatility of the spur-recess connecting.

Figure 7B:
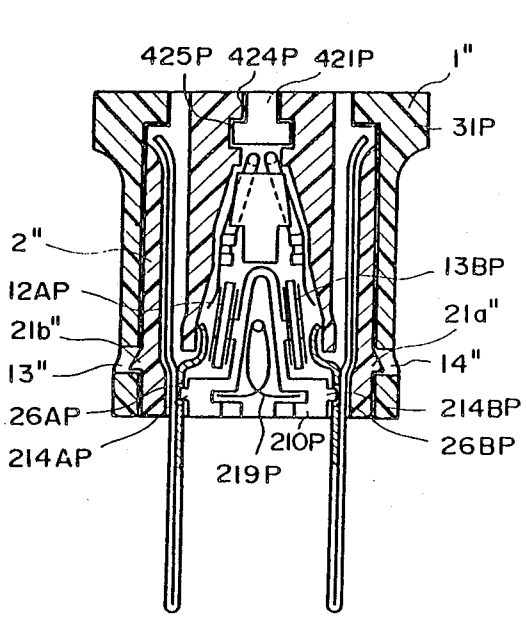
FIGS. 7A and 7B are longitudinal sections of another embodiment of the present invention.
Figure 7C:
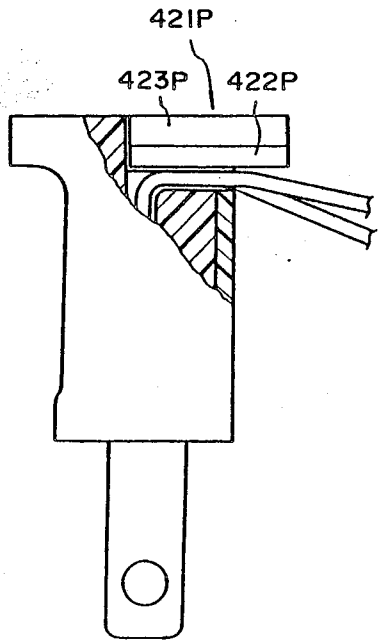
FIG. 7C is a side elevation of the embodiment socket/plug in FIGS. 7A and 7B with a partial section.
Figure 7A:
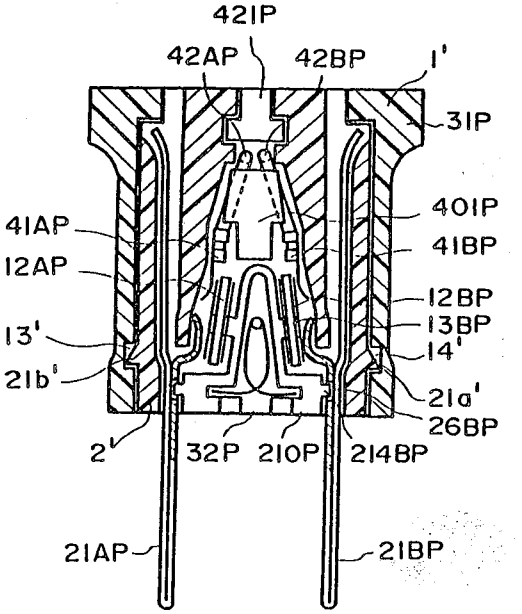

The parts within the housings 2' or 2'' have been described with connection to FIG. 1. Therefore, they shall not be detailed here. The original housing (now 2', 2'' corresponding to the so called "inner seat") is provided with inverted spurs 21*a'*, 21*b'* (21*a''*, 21*b''*) to be matched with the recesses 13', 14' (13'', 14'') in a new "outer casing" 1' (1''). A further difference exist between recesses 13', 14' and 13'', 14'', the latter two being through holes formed on the casing wall, the release of the inner seat or housing 2'' being easily effected by inserting a pin into the holes 13'', 14'', the spurs 21*a''*, 21*b''* being freed from their recesses immediately. FIG. 7*c* is supplementary to show the side of filling means 421P.

While specific embodiments of the invention have been shown and described in detail to illustrate the application of the principles of the invention, it will be understood that the invention may be embodied otherwise without departing from such principles.

What is claimed is:

1. An electrical plug comprising:

an insulating inner housing having a channel therein;

a pair of conductors extending into said channel having terminals fixed to ends thereof and disposed in said channel, a seat of insulated material in said channel between said terminals for fixing said terminals in said channel;

a pair of contacts extending into said insulating housing having at least a portion communicating with said channel;

a securing body of insulating material disposed in said channel between said contacts for holding said prongs to said insulating housing, said securing body being removable from said inner housing;

a pair of fuse members each disposed in said channel and electrically connected between one contact and one terminal, said securing body being engaged against at least one end of said fuses and between said fuses for fixing said fuse in said housing;

a pair of inverted spurs each disposed at a side wall of said housing;

an insulating outer casing having a through opening therein with an inlet and an outlet provided at opposite ends, and a pair of recesses at inside walls thereof; and said housing being removably inserted within the through opening of the outer casing with the spurs engaging the recesses.

2. The electrical plug according to claim 1, wherein the recesses provided on the wall of outer casing are holes through the casing wall.

3. The electrical plug according to claim 1, wherein a clearance is provided between the spur and recess connection, to facilitate the squeeze-release of the housing from the outer casing.

4. A plug according to claim 1, wherein said housing includes a pair of through slots on opposite sides of said channel, each contact having an extension extending in said through slot for making contact with another contact of another plug.

5. A plug according to claim 1, wherein said securing body has a pair of legs and biasing means for biasing said pair of legs apart, each leg having an engagement projection and each contact having a corresponding recess for receiving an engagement projection of one of said legs.

* * * * *